United States Patent [19]

Graham, III

[11] Patent Number: 4,562,707

[45] Date of Patent: Jan. 7, 1986

[54] OUTBOARD MOTOR ASSEMBLY LOCKING SYSTEM

[76] Inventor: Charles H. Graham, III, RD #2, Box 325 Pleasant View Dr., Manheim, Pa. 17545

[21] Appl. No.: 398,680

[22] Filed: Jul. 15, 1982

[51] Int. Cl.[4] ..... E05B 73/00

[52] U.S. Cl. ..... 70/58; 70/230; 411/87; 411/90; 411/99

[58] Field of Search ..... 70/229–232, 70/57, 58, 61, 62, 54–56, DIG. 57; 411/87–88, 90–92, 96, 99

[56] References Cited

U.S. PATENT DOCUMENTS

| | | | |
|---|---|---|---|
| 1,170,144 | 2/1916 | Evins | 411/99 |
| 1,741,205 | 12/1929 | Smith | 248/643 |
| 2,144,837 | 1/1939 | Douglas | 70/19 |
| 2,279,006 | 4/1942 | McWalters | 70/232 |
| 2,613,970 | 10/1952 | Holmsten | 292/148 |
| 2,677,264 | 5/1954 | Hanaford, Jr. et al. | 70/230 |
| 2,693,691 | 11/1954 | Pasanen | 70/229 X |
| 2,702,173 | 2/1955 | Young | 248/4 |
| 2,785,563 | 3/1957 | Strollis | 70/58 |
| 2,912,847 | 11/1959 | Putman et al. | 70/58 X |
| 3,808,851 | 5/1974 | Kargus et al. | 70/232 |
| 3,826,115 | 7/1974 | Davis | 70/230 X |
| 3,893,312 | 7/1975 | Johnson | 70/229 X |
| 3,943,738 | 3/1976 | Foote | 70/232 |
| 4,228,983 | 10/1980 | Bowman, Jr. | 248/553 |

FOREIGN PATENT DOCUMENTS

| | | | |
|---|---|---|---|
| 241102 | 10/1962 | Australia | 70/57 |

*Primary Examiner*—Kenneth J. Dorner
*Assistant Examiner*—Lloyd A. Gall

[57] ABSTRACT

A locking system for the type outboard motor assembly to a boat transom that is held by bolting through a motor mounting plate and through the boat transom includes: (a) the bolting being by round headed bolts with preferably non-circular section necks to prevent gripping the head and turning the bolts, (b) nuts on the forward face of the transom securing the bolts, (c) shielded perforate threaded collars on the free ends of the bolts and jamming tightly against the nuts, (d) a headed perforate stud through the perforations in the shielded perforate threaded collars to prevent them from being turned and (e) a padlock through one or more perforations in the free end of the headed perforate stud outboard the adjacent shielded perforate threaded collars to pervent unauthorized removal of the headed perforate stud.

1 Claim, 4 Drawing Figures

OUTBOARD MOTOR ASSEMBLY LOCKING SYSTEM

FIELD OF THE INVENTION

This invention relates generally to outboard motors and specifically to a system for detachably locking outboard motor assemblies to boats.

BACKGROUND OF THE INVENTION

Among related developments have been those disclosed in these U.S. Pat. Nos.:

1,741,205 issued to T. L. Smith on 12-31-29, discloses padlocking toggles on outboard motor clamps;

2,144,837 issued to J. L. Douglas on 1-24-39, discloses a lockable arm on a screw clamp of an outboard motor;

2,279,006 issued to A. M. Walters on 4-7-42, discloses capturing the crossbars of outboard motors clamping screws in a boxlike lockable tubular enclosure;

2,702,173 issued to R. E. Young on 2-15-55, discloses a left-and-right hand threaded rod for holding perforate toggle handles of an outboard motor clamp and preventing them from loosening;

2,785,563 issued to E. A. Strollis on 3-19-55, discloses a rod and lock to keep the rod from being removed from a bracket screwed to the transom; the rod is in position to prevent the clamps of an outboard motor from being lifted past it;

4,228,983 issued to J. H. Bowman, Jr. on 10-21-80 discloses a box-like hinged cover with lock to enclose the attaching mechanism of an outboard motor.

Each day many valuable outboard motors disappear from boats on which they are mounted. In most cases the motors could have been protected by a suitable locking system. However, no locking system available appears to have found widespread use. Excess cost, complex design, specialized design, difficult installation; loose fit, producing noise and damage from boat motion; cumbersome storage problems, excessive weight, ineffective protection and corrosion have evidently prevented various designs from becoming the standard in the industry for outboard motor locking to boats.

OBJECTS OF THE INVENTION

A principal object of the invention is to provide a system for locking outboard motors to boats, which can become a standard of the industry for the purpose.

Further objects are to provide a system as described which defeats unauthorized removal of outboard motors installed in boats, which is easy and quick to install, which is relatively light in weight and compact and takes up little room in shipping, installation and storage, and which is highly resistant to damage in use and in storage.

Still other objects are to provide a system as described which can be made of readily available parts of conventional material, conventionally fabricated, which is versatile in adaptation to fit different size and style installations, which can be employed in multiple for multiplied security in many installations, which is substantially rattle free and does not damage anything when installed, which is economical to make and to purchase, and which is unobtrusive and attractive in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
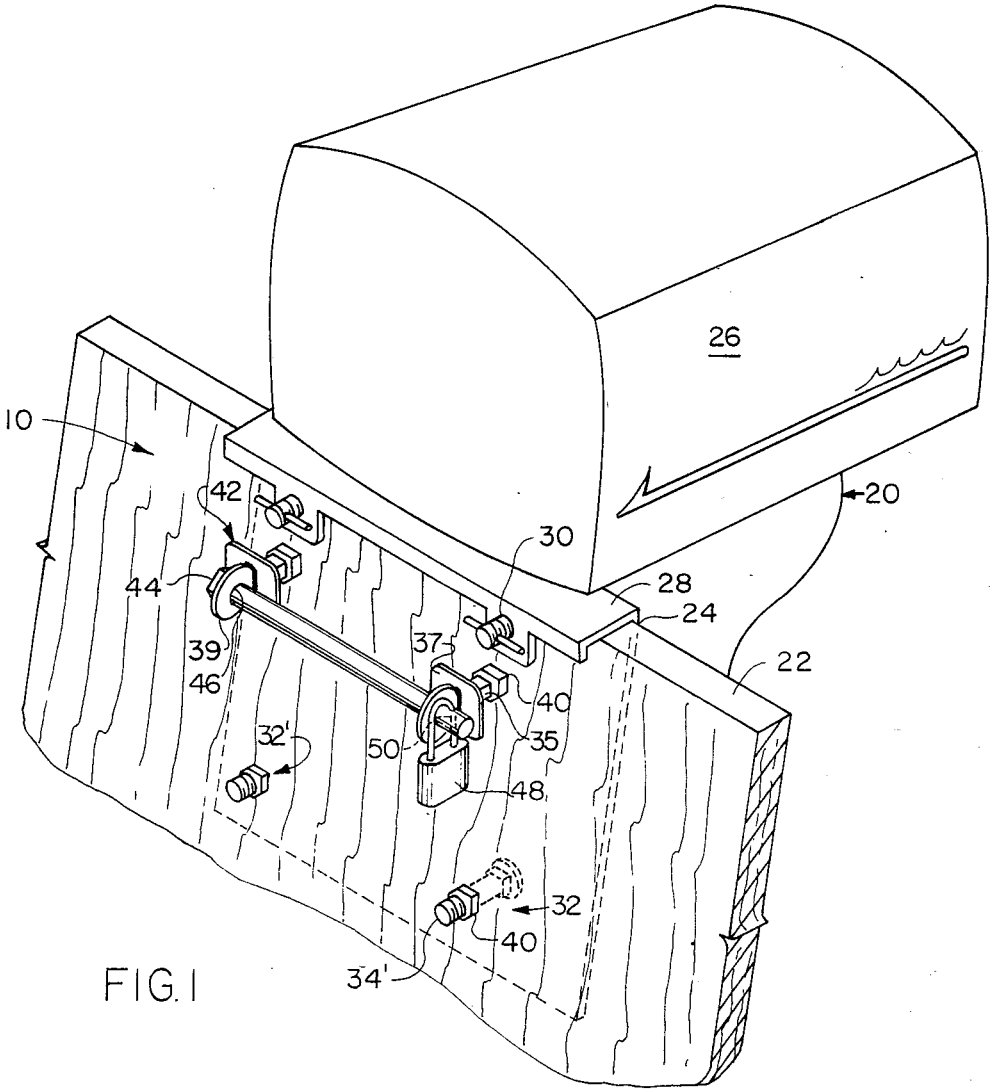
FIG. 1 is a top perspective view of the invention installed in a first mode to an outboard motor installation.
Figure 2:
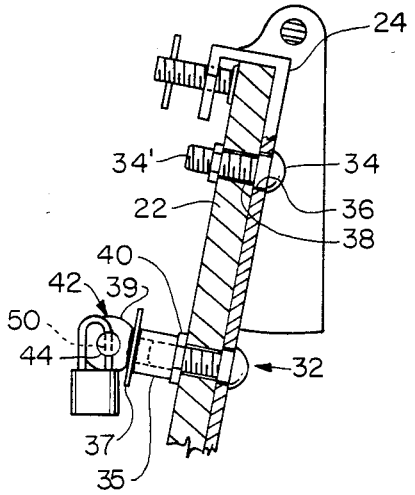
FIG. 2 is a side elevational detail in partial section showing the invention installed in a second mode.

FIGS. 1 and 2 show the locking system of the invention 10 in use locking an outboard motor assembly 20 to a boat transom 22. These two figures differ only in showing the invention secured at a different place; otherwise they are similar. The outboard motor assembly includes a conventional mounting plate 24 to which the outboard motor 26 is pivotally attached. The mounting plate may hook over the transom as at 28 and have conventional screw clamps 30 as part of the motor holding means.

Almost all the larger type outboard motors additionally have fastener assemblies 32 in the form of bolts 34 passing through mounting plate holes 36 and transom holes 38 and secured by nuts 40 on the forward side of the transom.

Each fastener in a pair 32, 32' is usually horizontally spaced from the other.

A second fastener assembly pair is often provided, below the first pair. Center distance between the second pair may or may not be the same as that between the first pair. According to the principle, the invention can be used between any pair desired.

In the invention, the bolts chosen are round headed carriage bolts, and preferably step-headed, with a square neck portion at the head, or else round-headed rib-neck carriage bolts. In either case, preferably the non-circular portion fit is such as to engage a hole 36 in the mounting plate and prevent turning the bolt, and in any case, the round heads provide no purchase for turning the bolts. The "round" portion is a spherical portion, as shown, but the heads could be countersunk to the same end. "Round-headed" is defined for purposes of this application to encompass both.

Length is chosen such that at least a few threads at the threaded end of the bolt protrude from the nut, as at 34'.

These special type and size fasteners may be considered as part of the invention, even though they are conventional.

The remainder of the invention can be applied in a few seconds to prevent removal of the fasteners. It includes an internally threaded length of round stock 35 (or hex stock, if desired) with plate-like shield 37 welded flat across one end, and a substantially planar heavy washer 39 welded on-edge centrally of the shield. The shield protects against bolt cutter access. One edge of the washer may be clipped to provide for a longer bead of welding. Further included is a headed perforate stud 44 having a diameter to provide a sliding fit inside the hole 46 in each washer. A perforation in the free end of the stud transverse to the axis accepts a standard padlock hasp in a free-sliding fit.

First, the unitary, shielded, perforate threaded collars 42 are screwed onto the protruding threaded ends 34' of the bolts and tightened to jam the nuts 40 against loosening.

Next, the headed perforate stud 44 is thrust through the holes or perforations 46 in the pair of perforate threaded collars 42, preventing rotation of these members.

Finally, a padlock 48 is secured in the free-end transverse perforation 50 of the headed perforate stud 44 outside the adjacent perforate collar, and the outboard motor assembly is locked to the boat. Removal is as quick and easy: the padlock is unlocked and removed, the headed perforate stud 44 is removed and the perforate threaded collars 42 are removed, leaving the nuts free for removal.

Figure 3:
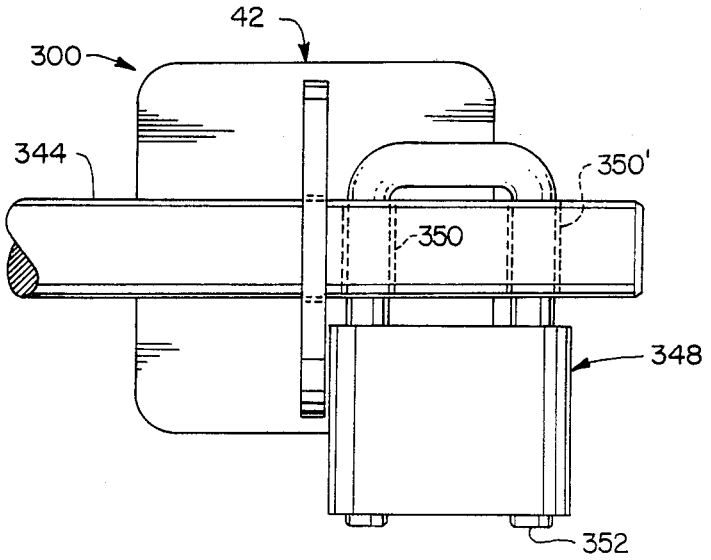
FIG. 3 is a fragmentary detail of an alternative embodiment lock installation.

FIG. 3 shows a detail of a second embodiment of the locking system 300 similar to the first except that headed perforate stud 344 has a pair of parallel holes or perforations 350, 350' matched to the end spacings of the "U" shaped hasp 352 of a detachable-hasp padlock 348. This variation is provided for even greater security in that cutting either side of the hasp would still not free the perforate headed stud.

Figure 4:
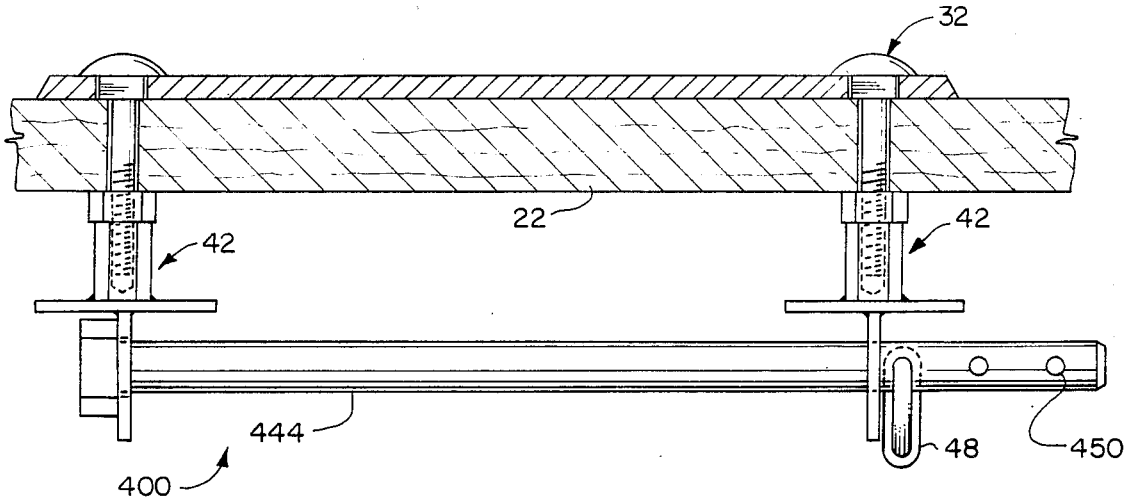
FIG. 4 is a plan view detail of a further embodiment installation.

FIG. 4 shows a detail of a further embodiment of the locking system 400 similar to the first except that one or more additional holes or perforations as at 450 through the headed perforate stud 444 are provided to suit different spacings between the centers of the motor securing fasteners 32.

From the above it can be seen that bolt-cutters, which are preferred by thieves for speed and silence, would find little to attack that could be cleanly and quickly severed. The headed perforate stud can be of case-hardened steel, preferably plated, or of stainless steel, and $\frac{5}{8}$ inch (15 mm) in diameter. The washers can be of similar material, $\frac{1}{8}$ inch (3 mm) thick and $1\frac{1}{2}$ inch (37 mm) in diameter.

The shielding plates can be of similar material $\frac{1}{8}$" (3 mm) thick and $1\frac{1}{2} \times 1\frac{1}{2}$ inch (37 mm$\times$37 mm) wide and high. The threaded sleeves can be of similar material 1 inch (25 mm) to 2 inches long, by 1 inch outside diameter.

Any suitable hardened padlocks may be used.

The holes 46 in the washers provide a means of snugging up the perforate threaded collars by insertion of an end of the headed perforate stud in them to turn them tight on the nuts and align the holes, and similarly to loosen them for removal.

It will be seen that the headed perforate stud can advantageously be thrust through from either side convenient or accessible for assembly, and that more than one padlock can be used with it. Further, all pairs of the fasteners described can be engaged by systems like this, and, if desired, vertically related pairs.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for locking an outboard motor (26), held in assembly on a boat transom, by bolts (34) having threads, the bolts passing as a spaced pair (32, 32') through a mounting plate (24) for the outboard motor (26) and through the transom (22) and held by nuts (40) at the forward face of the transom, the bolts having round heads as means for preventing purchase on the heads for turning the bolts and having respective threaded portions protruding from the nuts (40), the improvement comprising: a perforate threaded means (42) for engaging each bolt threaded protruding portion (34') and jamming against the respective nut (40) on the bolts (34), a headed stud means (44) for extending between and sliding through the perforation (46) of each perforate threaded means (42) and preventing rotation thereof, locking means (48) for preventing unauthorized withdrawal of the headed stud means from said perforate threaded means, each said bolt (34) having a noncircular shaped neck means for engaging said mounting plate and preventing turning of said bolt, the perforate threaded means (42) including a threaded tubular portion (35) with a shielding means (37) fixed flat across an end thereof with said perforation being in a substantially planar part (39) fixed in on-edge relation centrally to said shielding means (37), said locking means comprising a padlock with a hasp, and said hasp passing through at a hole in said headed stud means.

* * * * *